United States Patent [19]

Anderson

[11] Patent Number: 5,076,493

[45] Date of Patent: Dec. 31, 1991

[54] TAMPER EVIDENT GABLE TOP CARTON WITH RECLOSABLE SPOUT

[75] Inventor: Nestor A. Anderson, Parsippany, N.J.

[73] Assignee: Champion International Corporation, Stamford, Conn.

[21] Appl. No.: 542,906

[22] Filed: Jun. 25, 1990

[51] Int. Cl.[5] ..... B65D 5/74

[52] U.S. Cl. ..... 229/125.15; 220/288; 229/125.14

[58] Field of Search ..... 206/620, 621, 621.1, 206/621.2, 621.7; 220/288; 215/329; 229/125.09, 125.14, 125.15, 125.18; 222/541, 556, 557, 566

[56] References Cited

U.S. PATENT DOCUMENTS

| | | | |
|---|---|---|---|
| 2,400,716 | 5/1946 | Sattler | 229/125.15 |
| 3,127,082 | 3/1964 | Meyer-Jagenberg | 229/125.09 |
| 3,160,327 | 12/1964 | Porcelli | 222/541 |
| 4,483,464 | 11/1984 | Nomura | 222/83 |
| 4,591,091 | 5/1986 | Wise | 206/620 |
| 4,669,640 | 6/1987 | Ando et al. | 222/556 |
| 4,807,787 | 2/1989 | Langmeier et al. | 222/541 |
| 4,813,578 | 3/1989 | Gordon et al. | 222/541 |
| 4,830,273 | 5/1989 | Kalberer et al. | 229/125.15 |
| 4,909,434 | 3/1990 | Jones et al. | 229/125.15 |
| 4,964,562 | 10/1990 | Gordon | 229/125.15 |

FOREIGN PATENT DOCUMENTS

| | | | |
|---|---|---|---|
| 1054008 | 3/1959 | Fed. Rep. of Germany . | |
| 2659275 | 7/1978 | Fed. Rep. of Germany | 229/125.42 |

*Primary Examiner*—Gary E. Elkins
*Attorney, Agent, or Firm*—Evelyn M. Sommer

[57] ABSTRACT

A gable top container is provided with a bottom wall, an upstanding side wall enclosure connected to and extending from the bottom wall, and a gable top. The gable top is defined by an opposed pair of triangular top panels hingedly connected to opposed portions of the side wall enclosure, and a pair of opposed rectangular top panels hingedly connected to the side walls and folded over the triangular top panels. The triangular top panels and the rectangular top panels are connected to one another by triangular top web panels. One of the triangular top panels is provided with a pouring aperture formed therethrough or with an array of perforations for defining a pouring aperture. A resealable closure assembly is affixed to the triangular top panel having the pouring aperture therein. The resealable closure assembly includes a base securely affixed to the triangular top panel. The base includes an aperture in register with the aperture in one of the triangular top panels. The resealable closure assembly futher includes a cap threadedly engageable with the base to close the container but to permit selective opening thereof. The cap is initially from opening by the web panels adjacent thereto and portions of the rectangular top panels.

9 Claims, 3 Drawing Sheets

TAMPER EVIDENT GABLE TOP CARTON WITH RECLOSABLE SPOUT

BACKGROUND OF THE INVENTION

Gable top cartons are formed from a unitary blank of paperboard material that is scored and folded to define a bottom wall, an upstanding side wall enclosure extending from the bottom wall and a gable top. The bottom wall of the typical prior art gable top carton is square, while the side wall enclosure typically is defined by two opposed pairs of parallel side wall extending upwardly from and connected to the bottom wall. However, the prior art does include gable top cartons having circular bottom walls with a side wall enclosure that gradually transforms from a generally cylindrical bottom to a rectangular top.

The top of the prior art gable top carton is defined by a pair of opposed rectangular roof panels that are articulated to the side walls and converge toward one another. The rectangular roof panels are sealed to one another along edge regions remote from the side walls. The gable top of the prior art carton is defined further by triangular pour panels that are articulated from the remaining two side walls and also converge toward one another. Each triangular pour panel is connected to both rectangular roof panels by triangular web panels that extend therebetween. The prior art gable top carton is closed by initially rotating the triangular pour panels toward one another and subsequently rotating the rectangular roof panels toward one another for sealing engagement along the top edge regions thereof. Approximately half of the top edge seal of the prior art gable top carton defines a permanent seal, while the remaining portion defines a releasable seal. The releasable portions of the top seal can be separated from one another to enable the associated pour panel to be folded outwardly to define a pour spout for accessing the material stored in the carton. The pour panel ca be folded back inwardly to at least partly reseal the carton, and can be reopened for repeated access to the contents of the carton as needed.

Prior art gable top cartons have achieved tremendous commercial success and are widely employed for storing drinkable liquids, such as milk, juices and the like. Prior art gable top cartons also are used for storing other flowable materials, such as snack foods, cereals, pet foods, detergents and many other liquid or granular products. Despite this continued and substantial commercial success, it is desirable to further improve gable top cartons. In particular, many consumers find the initial opening of gable top cartons to be difficult. In this regard, the initial folding back of the triangular web panels and adjacent portions of the rectangular roof panels typically can be carried out easily by most consumers. However, the subsequent initial outward folding of the pour panel requires a separation of edge regions that had previously been sealed to one another. This separation normally is facilitated by careful application of adhesive, abhesive and/or coatings. However, many consumers still find this initial separation to be difficult. Additionally, many consumers who are adept at opening gable top cartons find significant variance from one carton to the next in view of the tendency of some paperboard material to delaminate. Thus, in some instances, the forces normally applied to effect the initial opening of a carton may cause a local delamination of paperboard material with corresponding opening difficulties and the creation of an inefficient pour spout.

In addition to problems associated with the initial opening of prior art gable top cartons, the resealing of such cartons may not be sufficiently effective to ensure freshness of the commodity stored therein or to prevent leaks during the shaking required for some beverages, such as orange juice. This may be particularly true for prior art gable top cartons that were at least partly damaged by the paperboard delamination during opening.

Consumers who have experienced or perceived problems with the prior art gable top cartons may resort to the available blow molded plastic containers. However, plastic containers present an environmental risk as compared to the paperboard gable top cartons that are formed substantially from biodegradable materials. Additionally, blow molded plastic containers require additional complex structure for tamper resistance or tamper evidence. The typical tamper resistant seal means for plastic containers may include a cap having an integrally formed frangible ring that is locked to the container and must be separated during the initial opening, a shrink-wrap overlay of plastic material and/or foil or paperboard seals disposed over the opening and beneath a removable plastic cap. The dexterity that is required to effect the initial opening of these tamper resistant plastic containers often is greater than the problems associated with the initial opening of the prior art gable top carton.

Recently there have been some attempts to combine the technology of gable top cartons with the openings of blow molded plastic containers. In particular, separate plastic pour spouts have been incorporated into the rectangular roof panels of gable top cartons. A removable cap is selectively attachable to the plastic pour spout in the rectangular roof panel for sealing the contents of the carton. However, this combination offers the potential for tampering, and consequently the above described tamper prevention means must be incorporated into the pouring spout and/or cap on the rectangular roof panel. As explained above, the known tamper prevention means can create very substantial opening difficulties for many consumers.

A gable top carton with a snap lock plastic cap and a mateable plastic spout on a pour panel of the gable top is shown in copending U.S. Patent Application Ser. No. 405,134, entitled "GABLE TOP CARTON WITH RESEALABLE POUR SPOUT", which was filed by Nestor A. Anderson and is assigned to the assignee of the subject invention. The disclosure of this copending application is incorporated herein by reference.

In view of the above, it is an object of the subject invention to provide a gable top carton having an easy opening and resealable pouring spout.

It is another object of the subject invention to provide a gable top carton that is tamper resistant and provides evidence of tampering.

It is another object of the subject invention to provide a gable top carton that does not require separate structure for tamper resistance or tamper evidence.

SUMMARY OF THE INVENTION

The subject invention is directed to a gable top carton having a threaded plastic pour spout incorporated into a pour panel thereof and a plastic cap threadedly engaged with the plastic pour spout. The subject invention is further directed to an assembly of components comprising a paperboard blank for forming a carton, a plastic pour spout selectively engageable with the blank and a plastic cap selectively engageable with the pour spout.

The carton of the subject invention comprises a unitary piece of paperboard material that may be coated on at least one side thereof to provide the necessary degree of moisture impermeability for the intended end use. The paperboard material may further be coated on an external side to facilitate imprinting of product indicia and to provide protection during filling, storage and distribution. The carton is formed to include a bottom wall, an upstanding side wall enclosure connected to and extending from the bottom wall and a gable top. The gable top includes a pair of opposed substantially isosceles triangular pour panels hingedly connected to the upstanding side wall enclosure and converging toward one another. One of the pour panels includes a aperture extending therethrough.

A closure assembly is mounted to the triangular pour panel with the aperture. The closure assembly comprises a base with a substantially cylindrical pour spout. The base may further be defined by a mounting flange adhered in face-to-face relationship with portions of the triangular pour panel surrounding the aperture therein. The mounting flange may be disposed either interiorly or exteriorly on the triangular pour panel, depending at least in part on the particular combination of coating materials on the interior and exterior of the carton and on the material being stored in the carton. Portions of the cylindrical pour spout remote from the mounting flange include an array of threads. A cap is threadedly engaged with the cylindrical pour spout either exteriorly or interiorly, with the preferred embodiment employing an external cap to ensure a larger surface area for gripping by the consumer, thereby facilitating the manual opening of the cap The gable top of the subject carton is further defined by a pair of opposed rectangular roof panels that converge toward one another in generally overlying relationship to the triangular pour panels of the carton. The rectangular roof panels are sealed to one another along edge regions remote from the upstanding side wall enclosure of the carton. The sealing of the triangular roof panels in overlying relationship to the pour panels functions as a tamper prevention means and tamper evidence means for the carton. In particular, the plastic cap of the carton can not be removed until the roof panels are initially separated from one another to access the plastic cap and enable its threaded removal. This initial separation of the roof panels is substantially identical to the first step in the opening of a conventional prior art gable top carton as explained above. This part of the opening process for prior art gable top cartons had not presented a problem to consumers, and therefore would not be anticipated to present problems in the context of the subject carton. Conversely, the subject carton avoids the subsequent folding out of the pour panel which had presented problems to some consumers employing the prior art gable top cartons.

It will also be appreciated that the tamper resistance provided by the sealed roof panels avoids the need to employ a cap having a frangible locking ring, a separate shrink wrap over the cap or a separate sealing foil secured over the plastic pouring spout. However, the inner top surface of the cap may have a foil lining to provide an enhanced gas and vapor barrier, and in particular to minimize transmission of oxygen. The subject design offers certain manufacturing efficiencies as well. In particular, it is unnecessary to provide the special adhesives, abhesives or coatings that had been required to facilitate the folding out of the pour panel during the initial opening of the prior art carton. Rather, the triangular web panels articulated to the pour panel remain permanently sealed to the top edge regions of the rectangular roof panels. Additionally, the threaded interconnection of the cap to the pour spout of the subject container can provide an efficient sealing that can enhance the life of certain materials that may be stored in the carton.

As noted above, the subject invention is further directed to an assembly of components for forming the above described container. The components of this assembly comprise a blank formed from a unitary piece of paperboard material that is scored to define the respective panels of the above described carton. One of the two isosceles triangular pour panels of the subject blank is provided with an aperture formed therethrough or with an array of perforations to facilitate the creation of an aperture of a selected shape. The assembly of components further includes the above described base having a mounting flange defining an area greater than the area of the hole in the pouring panel and a generally cylindrical pour spout extending unitarily from the mounting flange and defining a cross section substantially identical to the cross section of the aperture in the pouring panel. The cylindrical pour spout preferably comprises an array of external threads thereon, but may additionally or alternatively be provided with an array of internal threads. The assembly of components of the subject invention further comprises a cap that is threadedly engageable with the pour spout. Preferably, the cap is defined by a knurled exterior surface and an array of internal threads that are engageable with the threads of the pour spout.

DETAILED DESCRIPTION OF THE PREFERRED EMBODIMENT

Figure 1:
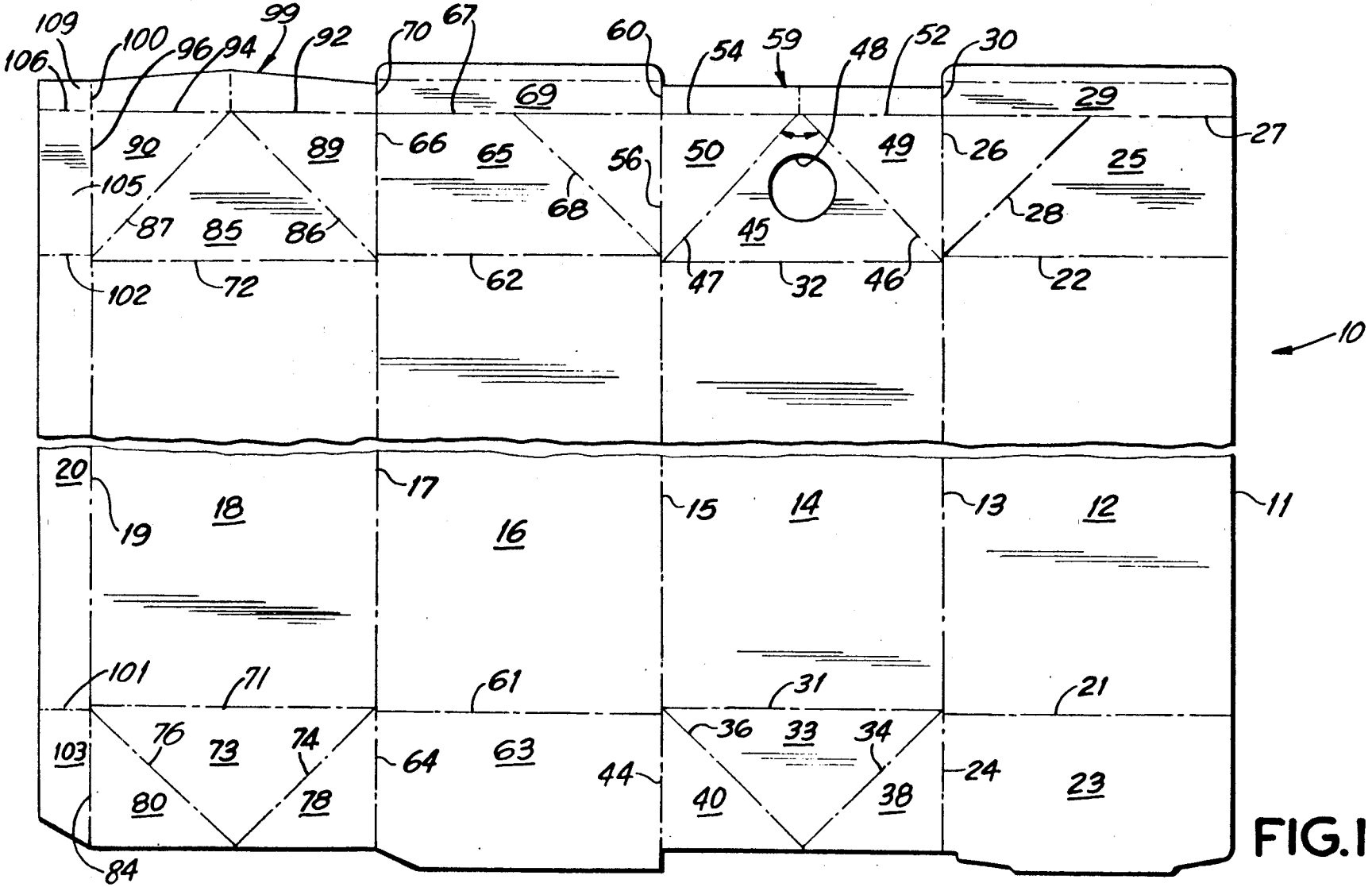
FIG. 1 is a top plan view of a blank in accordance with the subject invention.

A blank for forming the carton portion of the container of the subject invention is identified generally by the numeral 10 in FIG. The blank 10 is formed from a unitary piece of paperboard material. The paperboard may be coated or laminated to enhance the protection of the material stored in the container formed from the blank 10, and/or to provide an enhanced surface for printing product identifying indicia thereon. Appropriate coatings may be disposed on one or both sides of the blank 10.

The blank 10 is provided with an array of score lines which divide the panel into a plurality of hingedly connected panels. Adjacent panels can be folded relative to one another and about the score lines to form a gable top carton, as explained herein. In this regard, the blank 10 includes a rectangular first side panel 12, a rectangular second side panel 14, a rectangular third side panel 16, a rectangular fourth side panel 18 and a side seal panel 20, all of which are consecutively articulated to one another along parallel fold lines 13, 15, 17 and 19 respectively.

The first side panel 12 is further defined by an edge 11 of the blank 10 which extends parallel to the fold line 13. The first side panel 12 is further defined by a first bottom fold line 21 and a first top fold line 22 which extend generally parallel to one another and which connect the edge 11 of the blank 10 to the fold line 13 of the first side panel 12. As will be explained further below, the portion of the first side panel 12 adjacent to the edge 11 will be securely adhered to the side seal panel 20 on the carton formed from the blank 10.

A first bottom panel 23 is articulated to the first side panel 12 along the first bottom fold line 21. The first bottom panel 23 is of approximately rectangular configuration and is further defined by fold line 24 which extends generally colinearly from the fold line 13 and parallel to the edge 11 of the blank.

A rectangular first top panel 25 is articulated to the first side panel 12 along the first top fold line 22. The first top panel 25 will define one of the two rectangular roof panels on the carton erected from the blank 10. The first top panel 25 is of generally rectangular configuration, and is further defined by fold line 26 which extends colinearly from the fold line 13 and parallel to the edge 11. Additionally, the first top panel 25 is further defined by fold line 27 which extends parallel to the fold line 22 and between the edge 11 of the blank 10 and the fold line 26. The first top panel 25 is further characterized by a diagonal score line 28 which extends from the intersection of fold lines 22 and 26 to a point approximately midway along the fold line 27. The score line 28 effectively defines a corner of the roof panel on the carton that can be folded back to provide access to a pour spout used with the carton erected from the blank 10, as explained and illustrated below.

A generally rectangular first top seal panel 29 is hingedly connected to the first top panel 25 along fold line 27. The side of the first top seal panel 29 that will face inwardly on the carton erected from the blank 10 may be provided with an appropriate heat seal for securely attaching the first top seal panel 29 to other top seal panels as explained herein. The first top seal panel 29 is further defined by the edge 11 of the blank 10 and by fold line 30 which extends parallel to the edge 11 and generally colinearly from the fold line 26.

The second side panel 14 is further defined by second bottom fold line 31 and second top fold line 32 which extend substantially parallel to one another and which connect the fold lines 13 and 15. A second bottom panel 33 is articulated to the second side panel 14 along the second bottom fold line 31. The second bottom panel 33 is of isosceles triangular configuration and is further defined by fold lines 34 and 36 which converge toward one another from opposed ends of the second bottom fold line 31. A triangular web panel 38 is articulated to the second bottom pane 33 along fold line 34 and is further articulated to the first bottom panel 23 along fold line 24. A substantially identical bottom web panel 40 is articulated to the second bottom panel 33 along the fold line 36, and is further defined by a fold line 44 which extends substantially colinearly from the fold line 15.

A second top panel 45 is articulated to the second side panel 14 along fold line 32. The second top panel 45 also is of substantially isosceles triangular configuration, and is defined by fold lines 46 and 47 which converge toward one another from the opposed ends of the fold line 32. The second top panel 45 will define the pour panel on the carton erected from the blank 10. A circular array of perforations identified by the numeral 48 is defined in the second top panel 45. More particularly the circular array of perforations 48 defines a circular area that can be selectively depressed from the second top panel 45 to enable use of a plastic pour spout as explained further below. A circular cutout may be defined in place of the circular perforation array 48, thereby obviating the need to remove a portion of paperboard material at the time of use by the customer.

Triangular web panels 49 and 50 are articulated to the second top panel 45 along fold lines 46 and 47 respectively. The web panel 49 is further defined by the fold line 26 and by a fold line 52 which extends substantially colinearly from the fold line 27. The web panel 50 is further defined by fold line 54 which extends colinearly from the fold line 52 and by fold line 56 which extends colinearly from fold line 15 to intersect the fold line 54. A second top seal panel 59 is articulated to the web panels 4 and 50 along fold lines 52 and 54 respectively. The second top seal panel 59 is further defined by fold line 30 and by fold line 60 which extends colinearly from the fold line 56. Unlike prior art gable top cartons, the second top seal panel 59 may be securely adhered to other top seal panels, including the first top seal panel 29.

The third side panel 16 is further defined by a third bottom fold line 61 and a third top fold line 62 which extend generally parallel to one another and between the fold lines 15 and 17. A generally rectangular third bottom panel 63 is articulated to the third side panel 16 along fold line 61. The third bottom panel 63 is articulated to the web panel 40 along fold line 44, and is further defined by fold line 64 which extends substantially colinearly from the fold line 17.

A third top panel 65 is articulated to the third side panel 16 along fold line 62. The third top panel 65 is generally rectangular, and will define one of the two rectangular roof panels on the carton erected from the blank 10. In particular, as will be explained further below, the third top panel 65 will converge toward the first top panel 25 to define a pair of opposed converging rectangular roof panels which overlay the pour panel defined by the second top panel 45. The rectangular third top panel 65 is articulated to the web panel 50 along fold line 56. The third top panel 65 is further defined by fold line 66 which extends colinearly from the fold line 17 and by fold line 67 which extends parallel to the fold line 62 and between the fold lines 56 and 66. The third top panel 65 additionally is defined by a diagonal score line 68 which extends from the intersection of fold lines 56 and 62 to a location approximately midway along the fold line 67. The score line 68 will enable a corner of the third top panel 65 to be folded upwardly on the carton formed from the blank 10 to access the pour panel defined by the triangular second top panel 45. A third top seal panel 69 is articulated to the third top panel 65 along the fold line 67. The third top seal panel 69 is articulated to the second top seal panel 59 along fold line 60, and is further defined by fold line 70 which extends substantially colinearly from the fold line 66. A portion of the third top seal panel 69 will be securely and permanently adhered to the top seal panel 59 since it will be unnecessary to fold out the pour panel defined by the second top panel 45 as explained above and further herein.

The fourth side panel 18 is further defined by a fourth bottom fold line 71 and a fourth top fold line 72. A fourth bottom panel 73 of substantially isosceles triangular configuration is articulated to the fourth side panel 18 along the fourth bottom fold line 71. The fourth bottom panel 73 is further defined by fold lines 74 and 76 which converge toward one another from opposite ends of the fourth bottom fold line 71. Triangular web panels 78 and 80 are articulated to the fourth bottom panel 73 along fold lines 74 and 76 respectively. The triangular web panel 78 is further articulated to the third bottom panel 63 along fold line 64. The triangular web panel 80 is further defined by fold line 84.

A fourth top panel 85 is articulated to the fourth side panel 18 along the fourth top fold line 72. The fourth top panel 85 is of isosceles triangular configuration, and is defined by fold lines 86 and 87 which converge toward one another from opposite ends of the fourth top fold line 72. Triangular web panels 89 and 90 are articulated to the fourth top panel 85 along fold lines 86 and 87 respectively. The triangular web panel 89 is further articulated to the third top panel 65 along fold line 66, and is further defined by fold line 92 which extends colinearly from the fold line 67. The triangular web panel 90 is further defined b fold line 94 which extends colinearly from the fold line 92, and by fold line 96 which extends colinearly from the fold line 19. A fourth top seal panel 99 is articulated to the triangular web panels 89 and 90 along the collinear fold lines 92 and 94. The fourth top seal panel 99 is articulated to the third top seal panel 69 along fold line 70, and is further defined by fold line 100 which extends substantially colinearly from the fold line 96. The fourth top seal panel 99 will be securely adhered to portions of the third top seal panel 69 and the first top seal panel 29 on the carton erected from the blank 10.

The side seal panel 20 is further defined by bottom and top fold lines 101 and 102 which are parallel to one another and approximately aligned with the fourth bottom and top fold lines 71 and 72 respectively. A lower side seal panel 103 is articulated to the side seal panel 20 along the fold line 101 and is further articulated to the triangular web panel 80 along the fold line 84. An upper side seal panel 105 is articulated to the side seal panel 20 along fold line 102, and is further articulated to the triangular web panel 90 along fold line 96. The upper side seal panel 105 is further defined by fold line 106 which is approximately collinear with the fold line 94. A corner seal panel 109 is articulated to the upper side seal panel 105 along fold line 106 and is articulated to the fourth top seal panel 99 along fold line 100.

Figure 2:
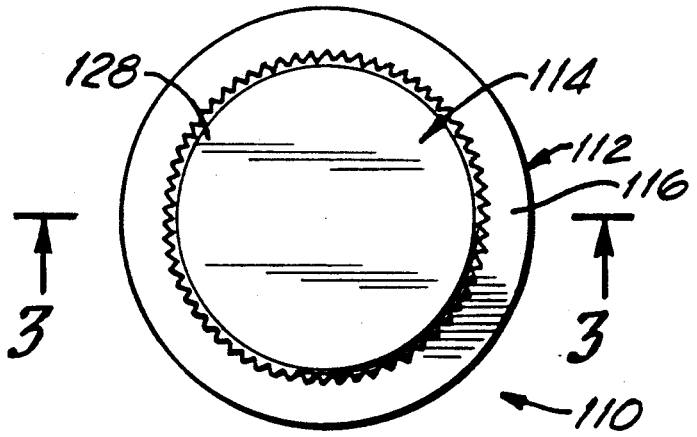
FIG. 2 is a top plan view of the combined pour spout and cap of the subject invention.
Figure 3:
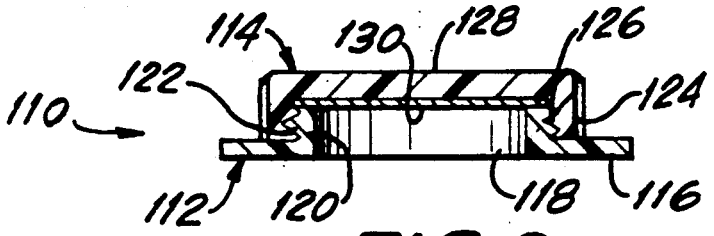
FIG. 3 is a cross-sectional view taken along line 3—3 in FIG. 2.
Figure 4:
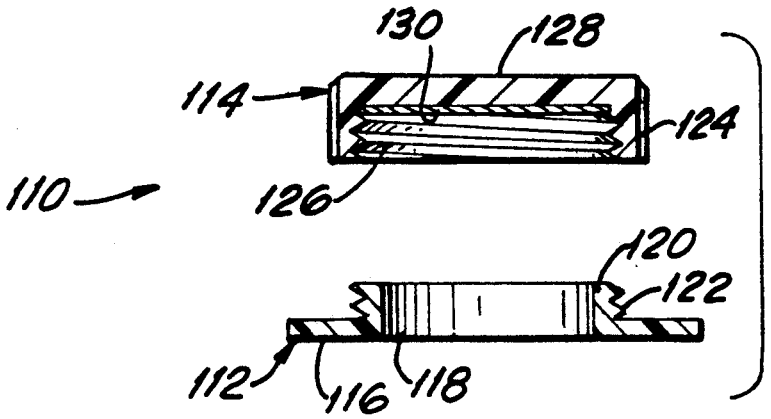
FIG. 4 is a cross-sectional view similar to FIG. 3 but showing the cap and pour spout in an exploded condition.

The assembly of components for forming the container of the subject invention further includes a closure assembly 110 which is illustrated in FIGS. 2–4 respectively. The closure assembly 110 comprises a base 112 and a cap 114. The base 112 is unitarily molded from a plastic material and includes generally planar mounting flange 116 with a circular aperture 118 extending therethrough. A substantially cylindrical pouring spout 120 extends uniformly upwardly from the mounting flange 116 and is concentric with the circular aperture 118. The outer circumferential surface of the pouring spout 120 is defined by an external array of threads 122.

The cap 114 includes a generally cylindrical engagement portion 124 having an array of internal threads 126 for threaded engagement with the threads 122 on the pouring spout 112. The cap 114 further includes a generally planar top portion 128 extending uniformly across the cylindrical engagement portion 124 and defining the portion of the cap 114 that will close the pouring spout 120. The cap 114 is further characterized by a sealing member 130 on the interior surface defined by the top 128. The sealing member 130 may be a paperboard material, a foil or a plastic material that will sealingly but releasably engage the portion of the cylindrical pouring spout 120 remote from the mounting flange 116.

Figure 5:
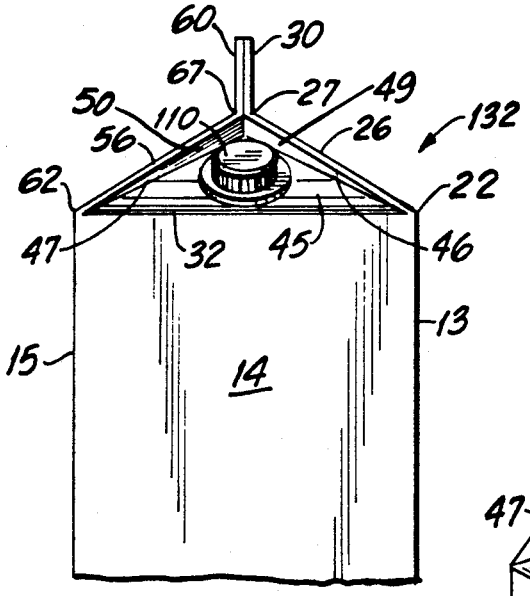
FIG. 5 is a front elevational view of the erected carton of the subject invention.
Figure 6:
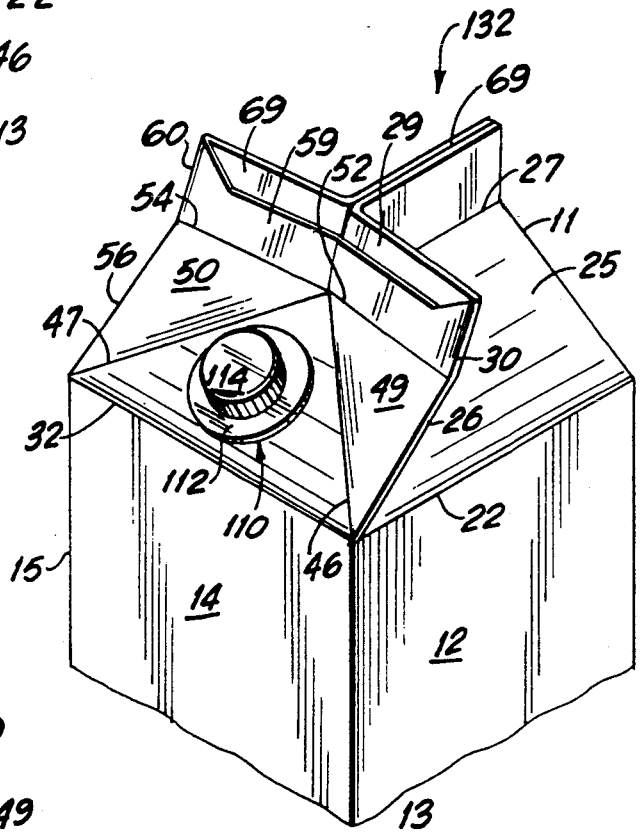
FIG. 6 is a perspective view of the carton at a first stage during opening.
Figure 7:
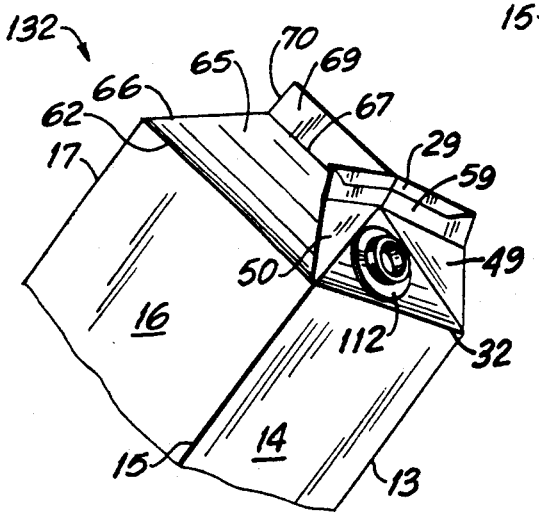
FIG. 7 is a perspective view of the opened carton with the cap thereof disengaged and in an orientation for pouring material therefrom.

The blank 10 and the closure assembly 110 are formed into the container 132 which is depicted in FIGS. 5–7. A preferred first step for manufacturing the container 132 is to form the blank 10 into a tubular structure in substantially the conventional manner. In particular, the first through fourth side wall panels 12, 14, 16 and 18 are consecutively articulated about the fold lines 13, 15 and 17 to defined a generally tubular structure. The side seal panel 20, the lower side seal panel 103, the uppei side seal panel 105 and the corner seal panel 109 are then securely adhered to the portions of the blank 10 adjacent the edge 11.

As a next step, the closure assembly 110 is attached to the partly formed blank 10. In particular, the mounting flange 116 of the base 112 is attached to the second top panel 45 such that the aperture 118 therein surrounds the cutout defined by the perforations 48 in the second top panel 45. The attachment may be carried out by application of adhesive, ultrasonic welding or heat sealing. This step may be carried out such that the flange 116 is disposed exteriorly on the carton 132 as depicted in FIGS. 5–7 or, alternatively, interiorly with the pouring spout 120 extending through the cutout defined by the perforations 48.

The tubular structure described above typically is formed into a container at the facility where the container is to be filled. As part of these final steps, the bottom of the container is closed by rotating the second and fourth triangular bottom panels 33 and 73 inwardly about fold lines 31 and 71 respectively. The first and third rectangular bottom panels 23 and 63 then similarly are rotated inwardly about the fold lines 21 and 61 respectively. These inwardly folded and overlapped bottom panels are securely adhered in overlapping relationship to define a sealed bottom for the container 132.

At this point in the construction, the top portion of the container 132 is still open and can be filled with an appropriate flowable material to be stored in the container 132. After filling the second and fourth triangular top panels 45 and 85 are rotated inwardly about the fold lines 32 and 72 respectively. The rectangular first and third top panels 25 and 65 are then rotated inwardly toward one another about the fold lines 22 and 62 respectively. In this condition, the top seal panels 29, 59, 69 and 99 are securely adhered or heat sealed to one another. This top closure is substantially free of the abhesives that had been employed in the prior art.

As depicted most clearly in FIG. 5, the second top panel 45 will define a pour panel that is disposed directly beneath the triangular web panels 49 and 50 and beneath the adjacent portions of the first and third top panels 25 and 65 which define the rectangular roof panels for the gable top container 132. Additionally, as shown most clearly in FIG. 5, the triangular web panels 49 and 50 and adjacent portions of the rectangular roof panels 25 and 65 securely cover portions of the closure assembly 110 to prevent the threaded removal of the cap 114 from the base 112. In particular, the cap 114 is not readily accessible in the sealed condition of the container 132 depicted in FIG. 5. Furthermore, even if portions of the cap 114 could be accessed in the FIG. 5 condition, threaded removal is positively prevented by the adjacent web panels 49 and 50.

With reference to FIG. 6, the container 132 is initially opened by first rotating the triangular web panels 49 and 50 about the fold lines 46 and 47 respectively and simultaneously thereby folding the adjacent corners of the first and third top panels 25 and 65 about the diagonal fold lines 28 and 68 respectively. This causes a separation of portions of the second top seal panel 59 that had been secured in folded relationship to itself. This initial separation can be carried out easily and provides convenient access to the cap 114 of the closure assembly 110.

The container 132 may then be used by threadedly separating the cap 114 from the base 112 and enabling the material stored in the container 132 to be poured from the pouring spout 120. The cap may be threadedly repositioned on the spout 120 between periodic uses of the container 132.

In summary, a gable top container is provided with a paperboard carton structure having a gable top and having a threaded closure assembly securely affixed to one of the triangular pour panels. In the initial unopened condition of the carton, the cap assembly is securely retained beneath the rectangular roof panels to prevent tampering, provide evidence of tampering attempts and to prevent accidental opening of the container. The container may be employed by folding back corner regions of the rectangular roof panels to access the plastic closure assembly. The container is further employed by threadedly removing the cap of the closure assembly to enable material stored in the container to be poured from the spout.

While the invention has been defined with respect to a preferred embodiment, it is apparent that various changes can be made without departing from the scope of the invention as defined by the appended claims. For example, gable top cartons with cross sectional configurations other than the generally square shape shown herein may be employed. Furthermore, cartons with non-rectangular bottoms may be employed. The pouring spout assembly may further take other configurations, such as configurations where the mounting flange of the base is disposed interiorly on the carton and/or where the cap is engaged to interiorly disposed threads on the spout. These and other variations will be apparent to the person skilled in this art after having read the subject disclosure.

I claim:

1. A gable top carton comprising:

a carton having a bottom wall, an upstanding side wall enclosure connected to and extending from the bottom wall, a pair of opposed triangular top walls hingedly connected to opposed portions of the side wall enclosure at locations thereon remote from the bottom wall, a pair of opposed generally rectangular top walls hingedly connected to opposed portions of the upstanding side wall enclosure at locations thereon remote from the bottom wall, triangular web panels connected to and extending between the respective triangular top panels and the rectangular top panels, said rectangular top panels and said triangular web panels being folded into generally overlying relationship to the triangular top panels, and being sealed to one another at portions thereof remote from the side wall enclosure, a first of said triangular top panels being provided with an aperture means therein for permitting material stored in said carton to be poured therefrom; and a resealable closure assembly securely connected to the first triangular top panel in overlying relationship to the aperture means therein, said resealable closure assembly comprising a base having an opening extending therethrough, said base being affixed to the first triangular top panel such that the opening in the base is substantially in register with the aperture means in the first triangular top panel, and a cap selectively threadably engageable with the base for securely closing the opening in the base and the aperture means in the first triangular top panel, said triangular web panels articulated to the first triangular top panel being disposed substantially adjacent the cap of the resealable closure assembly for preventing removal of the cap from the base, whereby the carton is openable by initially rotating the triangular web panels articulated to the first triangular top panel away from said first triangular top panel.

2. A carton as in claim 1 wherein the base of the resealable closure assembly is unitarily molded from a plastic material.

3. A carton as in claim 1 wherein the base of the resealable closure assembly comprises a substantially planar mounting flange securely affixed to the first triangular top panel and a generally cylindrical pouring spout extending unitarily from the mounting flange and being substantially in register with the aperture means in the first triangular top panel of the carton.

4. A carton as in claim 1 wherein the base of the resealable closure assembly is securely affixed to the first triangular top panel by ultrasonic welding.

5. A carton as in claim 1 wherein the base of the resealable closure assembly is securely affixed to the first triangular top panel by heat sealing.

6. A carton as in claim 1 wherein the base of the resealable closure assembly is securely affixed to the first triangular top panel by an adhesive.

7. A carton as in claim 1 wherein the secure attachment of regions of the gable top remote from the side wall enclosure is substantially free of abhesive.

8. A carton as in claim 1 wherein the gable top is securely closed by heat sealing.

9. A carton as in claim 1 wherein said upstanding side wall enclosure comprises four rectangular side walls consecutively articulated to one another.

* * * * *